United States Patent [19]

Zedrosser

[11] Patent Number: 4,702,144

[45] Date of Patent: Oct. 27, 1987

[54] COCKING SLIDE FOR AUTOMATIC HAND FIREARMS

[75] Inventor: Ulrich Zedrosser, Steyr, Austria

[73] Assignee: Steyr-Daimler-Puch AG, Vienna, Austria

[21] Appl. No.: 872,281

[22] Filed: Jun. 9, 1986

[30] Foreign Application Priority Data

Jun. 19, 1985 [AT] Austria ..... 1813/85

[51] Int. Cl.[4] ..... F41D 11/00

[52] U.S. Cl. ..... 89/1.4; 89/181

[58] Field of Search ..... 89/1.4, 181

[56] References Cited

U.S. PATENT DOCUMENTS

| | | | |
|---|---|---|---|
| 3,774,498 | 11/1973 | Moller et al. | 89/1.4 |
| 3,938,422 | 2/1976 | Tellie | 89/1.4 X |
| 4,191,089 | 3/1980 | Zedrosser | 89/181 |
| 4,395,937 | 8/1983 | Ottolini | 89/1.4 X |
| 4,565,113 | 1/1986 | Bunning | 89/1.4 |

FOREIGN PATENT DOCUMENTS

| | | |
|---|---|---|
| 727310 | 10/1942 | Fed. Rep. of Germany . |
| 2023523 | 11/1971 | Fed. Rep. of Germany . |

*Primary Examiner*—David H. Brown

*Attorney, Agent, or Firm*—Marmorek, Guttman & Rubenstein

[57] ABSTRACT

A cocking slide (2,3) for automatic hand firearms serves for manually pulling back the spring loaded lock of the weapon by means of a one-way coupling (8,9). The cocking slide (2,3) comprises a handle (3), projecting laterally from the weapon, which possesses a device (11,12,13) for arbitrarily blocking the one-way coupling (8,9). In order to safeguard the cocking slide (2,3), in spite of it being easy and safe to actuate, against damage by the effect of external forces, and to enable the lock to be urged forward by means of the cocking slide (2,3), the handle (3) consists of a guiding part (4) and a grip part (6). The grip part (6) is spring-loaded and slewable about an axle parallel with the barrel. Moreover, the grip part is slewable toward the weapon against spring bias over the entire path of the cocking slide, whereby the one-way coupling (8,9) can be blocked.

8 Claims, 4 Drawing Figures

COCKING SLIDE FOR AUTOMATIC HAND FIREARMS

Figure 1:
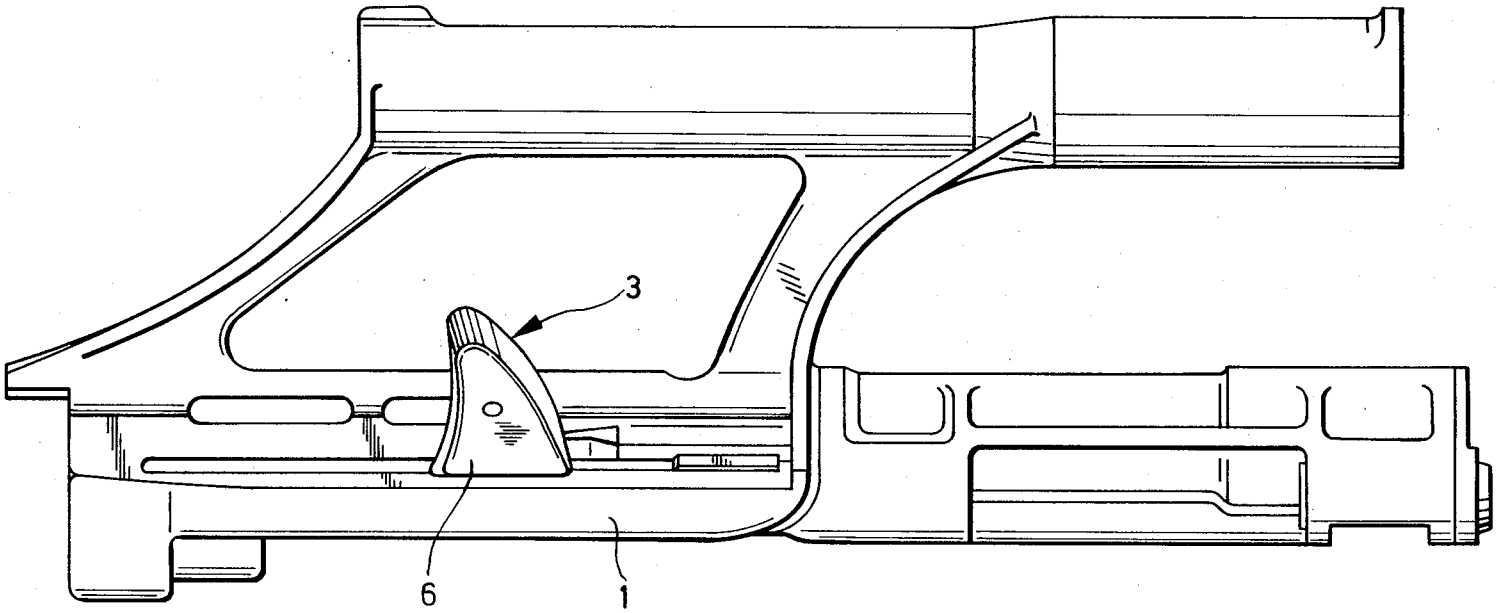

The invention relates to a cocking slide for automatic hand firearms for drawing back by hand the spring-loaded lock by means of a one-way coupling, with the cocking slide comprising a handle, protruding laterally from the weapon, which possesses a device for arbitrarily arresting the one-way coupling.

It is known to pull back the lock with the aid of the cocking slide in order to work the slide of the weapon prior to firing the first shot, in which case the one-way coupling makes it possible that the laterally projecting handle does not have to participate, in a sequence of several shots, in the forward and rearward movement of the lock, but, after it has been returned to its starting position by the advancing lock after the first rearward movement, it will remain in that position. Of course, the cocking slides must be so designed and arranged that they can be seized and actuated by the marksman under all possible conditions, even without seeing. For this reason, the handle which is provided at the cocking slide, projects, as a rule rather considerably, beyond the outer contours of the weapon. Due to this lateral projection, the handle of the cocking slide is exposed abnormally to stresses by forces caused by a blow, knock or bending, can, therefore, be damaged easily, and thus impair the capability of the weapon to function properly.

In the case of an insufficient closing movement of the lock, for instance due to strong fouling of the guiding means for the lock, the sequence of shots will be interrupted. Now, as the handle of the cocking slide possesses a device for arbitrary blocking of the one-way coupling, it is possible, not only to pull back the cocking slide of the lock against the force of the spring, but also to press it forward manually after blocking of the one-way coupling and thereby to close and/or bolt it. Hitherto, for blocking the one-way coupling, there had been provided a separate pressure button or the like which must be actuated apart and renders the use of the weapon more difficult, in particular in the dark.

From DE-C-20 23523, there is already known a cocking slide having a handle provided with a joint and being swivelled forward, by the action of a spring, about an axis arranged transversely to the direction of the barrel, so that it lies closely on the weapon housing, and is thereby well protected against damage. But in this case it is difficult to seize this forwardly swivelled handle rapidly and securely in order to actuate the cocking slide, as the handle is not easy to seize and there is a danger of injuries due to burning by the heating weapon housing when the weapon has become hot by firing. Moreover, in this case, a lock for the one-way coupling is missing, so that the cocking slide is unsuitable for urging the lock forward and/or for closing or bolting it. There is also known from DE-C-727 310 a cocking slide which is provided with a handle projecting laterally from the weapon. The handle thereof consists of a guiding part and a spring-loaded grip part being slewable in a limited manner about an axis parallel with the barrel. In this case, the guiding part is connected rigidly with the cocking slide or the cocking slide sere, respectively. The minor slewability of the grip part only serves in this case to arrest the cocking slide in its forward end position, while the spring effects the automatic lock-in. A shifting of the grip part outside the end position is not possible.

Thus, the invention is addressed to the task to provide a cocking slide of the initially described kind which is safe from damage by the influence of external forces, in spite of being easily and securely actuated, and which is, moreover, suitable also for urging the lock forward.

The invention solves this task by that the handle consists of a guiding part and a spring-loaded gripping part which is slewable in a limited manner about an axis parallel with the barrel, and the gripping part is slewable toward the weapon against the force of the spring during the entire path of the slide, and the one-way coupling can thereby be blocked.

During normal use of the weapon, the grip part projects laterally away from the weapon casing sufficiently far to enable the marksman to seize the same easily and, in a given case, even without seeing. However, when the handle is stressed by a blow or knock, e.g. when the weapon is dropped, then the grip part can move evasively by swivelling toward the weapon or the weapon housing, respectively, and is thereby protected against damaging or even against breaking. But this swivelling movement toward the weapon or the weapon housing, respectively, also fulfills a further task in that it effects the blocking of the one-way coupling, so that the lock can be brought into the bolting position by means of the cocking slide, without having to provide additional actuating elements at the cocking slide or at any other part of the weapon.

A particularly appropriate, but also structurally simple embodiment of the cocking slide is obtained, in accordance with the invention, by that the guiding part of the handle, in order to form the one-way coupling, abuts with a frontal face against a shoulder of a rod, being rigidly connected with the lock, which extends into a bore of the guiding part and there has an annular groove or the like having conical flanks, by which annular groove there is engaged a blocking pin which is supported in the guiding part displaceable radially relative to the rod, while the grip part is provided with an excenter or the like which provides a check against the displacement of the blocking pin when the grip part has been swivelled toward the weapon. Due to the conical flanks of the annular groove or the like, the blocking pin is radially displaced, when the rod being connected with the lock carries out a relative movement vis-a-vis the guiding part, without being able to effect blocking. However, as soon as the grip part is being swivelled and, thereby, the excenter or the like comes to lie in front of the blocking pin, the latter is prevented from displacement, and the desired coupling of the handle with the locking slide results in both directions, i.e., the one-way coupling, present up to that point, becomes blocked.

Figures 2, 3:
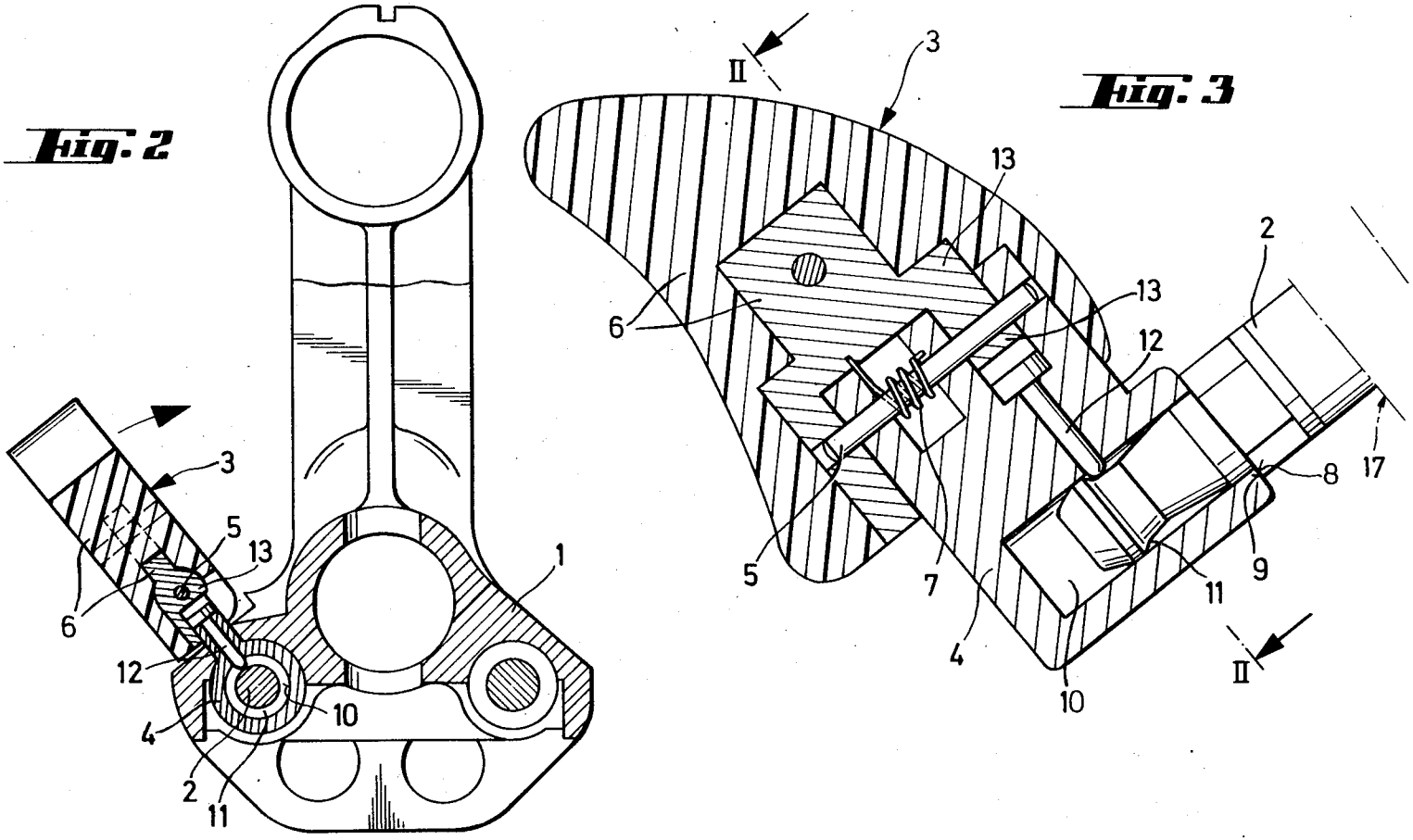
Figure 4:
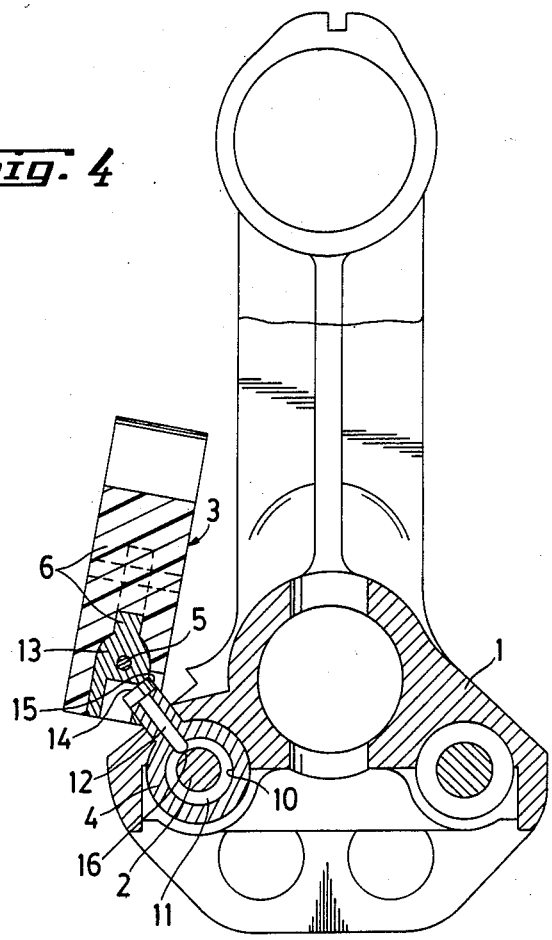

In the drawing, the subject of the invention is illustrated in an embodiment, and there are showing FIG. 1 in lateral view the housing of an automatic rifle with a cocking slide, but without barrel, lock or other parts, FIG. 2 a cross-section, pertaining thereto, in the region of the handle of the cocking slide, along the line II—II of FIG. 3, and FIG. 3 the handle with one end of the rod in a section parallel with the barrel axis, FIG. 4 a cross-section in the region of the handle of the cocking slide, along the line II—II of FIG. 3, showing the handle slewed toward the weapon housing.

The cocking slide is guided in the weapon housing 1 in parallel with the barrel axis and consists of a rod 2 fixedly connected with the lock (17) and a handle 3 projecting laterally from the weapon or the weapon housing 1, respectively. The handle 3 is not designed of one piece, but comprises a guiding part 4 which bears a grip part 6 being slewable about a shaft 5, parallel with the barrel, which grip part is composed of a metal core piece and a hull of synthetic resin material. A small spring 7 is wound about the shaft 5, parallel with the barrel, and urges the grip part 6 toward the normal stop-limited position illustrated in FIGS. 1 and 2. The grip part 6 can be swivelled toward the weapon or weapon housing 1, respectively, against the force of this spring 7.

In order to be able to pull back the lock, upon which a relatively strong spring is acting, with the aid of the cocking slide there is present a one-way coupling which is formed by that the guiding part 4 of the handle 3 abuts with its frontal face 8 against the shoulder 9 of the rod 2 which is firmly connected with the lock. This rod 2 extends with its free end into a bore 10 of the guiding part 4, this end of the sere forming an annular groove 11 having conical flanks. A blocking pin 12 projects into this annular groove 11 and is supported, in the guiding part 4 of the handle 3, displaceable radially relative to the rod 2. In the position illustrated in FIG. 3, the rod 2 can be pulled out without difficulty toward the right outwardly from the guiding part 4 of the handle 3, because the blocking pin 12 is urged upwardly owing to the conical groove flanks and has sufficient play at the top. If, however, the handle 3 itself is moved to the right, then it will take along the rod 2, as the frontal face 8 abuts on the shoulder 9. A spring-loaded lock 17 is firmly connected to the rod 2. The metal core of the grip part 6 possesses an excenter 13 which will be turned as a check over the blocking pin 12, when the grip part 6 is swivelled toward the weapon housing 1, i.e. clockwise according to FIG. 2, whereby the blocking pin 12 is impeded from carrying out a radial displacement vis-á-vis the annular groove 11 and there is achieved a coupling of the handle 3 with the rod 2 in both directions with regard to the rod displacement.

In the position illustrated in FIG. 4, the handle 3 is shown slewed toward the weapon housing. In this position, edge 15 of excenter 13 is pressed against the top area 14 of the blocking pin 12, thereby holding the blocking pin 12 in the position shown. The blocking pin 12 in turn blocks the rod 2 because the end 16 of the blocking pin 12 is pressed into the annular groove 11 of rod 2. If the handle 3 is released and slewed back into the position of FIG. 3 by the spring 7, the force is removed from the blocking pin 12, thereby allowing its movement in the radial direction from the rod 2.

I claim:

1. A cocking slide for automatic hand firearms, comprising a housing of a firearm, a handle projecting away from said housing, said handle including gripping means and guiding means, an axle disposed in said handle and substantially parallel to said housing, said gripping means being limitedly slewable about said axle, spring means disposed on said axle, said spring means biasing said gripping means away from said housing, coupling means abutting said guiding means and forming a one-way coupling when said handle is moved away from said housing, and blocking means supported in said guiding means, said blocking means engaging said coupling means and limiting the movement of said handle when said gripping means is slewed toward said housing.

2. The cocking slide of claim 1, wherein said guiding means includes a frontal face and said coupling means includes a shoulder, said frontal face abutting said shoulder when said handle is moved away from said housing.

3. The cocking slide of claim 2, further comprising a spring-loaded lock disposed within said firearm, said coupling means connected to said lock, said blocking means engaging said coupling means at a predetermined point when said handle is moved toward said housing.

4. The cocking slide of claim 3, wherein said coupling means comprises a rod protruding into a bore of said guiding means, said rod including an annular groove, said blocking means engaging said annular groove at said predetermined point when said gripping means is slewed toward said housing.

5. The cocking slide of claim 4, wherein said gripping means includes an excenter, said excenter acting as a check against displacement of said blocking means when said gripping means is slewed toward said housing.

6. The cocking slide of claim 5, wherein said blocking means comprises a pin.

7. A cocking slide for automatic hand firearms, comprising a housing of a firearm, a spring-loaded lock disposed within said firearm, a handle projecting away from said housing, said handle including gripping means, an axle disposed in said handle and substantially parallel with said housing, said gripping means being limitedly slewable about said axle, spring means disposed on said axle, said spring means biasing said gripping means away from said housing, said handle also including guiding means, said guiding means including a frontal face, a rod connected with said lock and protruding into a bore of said guiding means, said rod including a shoulder, said frontal face abutting said shoulder and forming a one-way coupling when said handle is moved away from said housing, said rod also including an annular groove, and blocking means supported in said guiding means, said blocking means engaging said annular groove at a predetermined point when said gripping means is slewed toward said housing, said gripping means including an excenter, said excenter acting as a check against displacement of said blocking means when said blocking means engaged said annular groove.

8. The cocking slide of claim 7, wherein said blocking means comprises a pin.

* * * * *